US005741017A

United States Patent [19]

Chen

[11] Patent Number: 5,741,017

[45] Date of Patent: Apr. 21, 1998

[54] ADJUSTABLE BRAKE MECHANISM FOR ROLLER SKATES

[76] Inventor: Henry Chen, 10F, No. 145, Sec. 2, Ming Sheng E. Road, Taipei, Taiwan

[21] Appl. No.: 508,535

[22] Filed: Jul. 28, 1995

[51] Int. Cl.[6] ..... A63C 17/14

[52] U.S. Cl. ..... 280/11.2; 188/5

[58] Field of Search ..... 280/11.2, 11.22, 280/11.23, 11.27; 188/5

[56] References Cited

U.S. PATENT DOCUMENTS

| | | | |
|---|---|---|---|
| 5,067,736 | 11/1991 | Olsen et al. | 188/5 |
| 5,253,883 | 10/1993 | Moldenhauer | 188/5 |
| 5,482,301 | 1/1996 | Babcock | 280/11.2 |
| 5,511,804 | 4/1996 | Pellegrini, Jr. et al. | 188/5 |

FOREIGN PATENT DOCUMENTS

| | | | |
|---|---|---|---|
| 0414521 | 2/1991 | United Kingdom | 280/11.2 |
| 0518694 | 12/1992 | United Kingdom | 280/11.2 |

*Primary Examiner*—Brian L. Johnson
*Assistant Examiner*—Bridget Avery
*Attorney, Agent, or Firm*—Morton J. Rosenberg; David I. Klein

[57] ABSTRACT

Disclosed is a height-adjustable brake mechanism for roller skates, mainly including a fixing member, a movable member fitly and adjustably covered over the fixing member, a fixing bolt member for adjustably attaching the movable member to the fixing member, and a brake block attached to the movable member at a proper position and height for safely braking the roller skates when necessary. The fixing and the movable members have upward arched curved bodies and are provided with toothed top surfaces and toothed lower edges, respectively, which mesh with each other to allow the two members to engage with each other in a firm and finely adjustable manner. Teeth on the toothed portions of the two members are designed to have a certain declination that permits the movable member to be pushed backward relative to the fixing member only. To adjust the position of the movable member relative to the fixing member, just loosen the fixing bolt member to disengage it from a threaded hole on the fixing member without being moved out of the movable member, push the movable member to a desired lower position, and then tighten the fixing bolt member against the fixing member again. The brake block attached to the bottom of the movable member can therefore be lowered for further use when it is worn and becomes shortened.

2 Claims, 5 Drawing Sheets

ADJUSTABLE BRAKE MECHANISM FOR ROLLER SKATES

BACKGROUND OF THE INVENTION

Skating, especially roller skating, is a popular leisure activity and a good sport suitable for all ages in different heights. Roller skates are commercially available for a very long time. The conventional roller skates have a brake block attached by means of screws to a rear end thereof. That is, the rear brake block is attached to the skate at a fixed position and height. However, since users are different in height and have different habits in using the skates, the fixedly attached brake blocks at fixed height on the skates are not necessarily suitable for all users. When a user who is not used to the brake block fixed at a certain height might very possibly hurt his or her ankle or ankles or other areas on his or her feet when he or she is doing a braking movement. In addition, brake blocks are made of wearing material and therefore, become shortened in length after being used for a long time. The shortened brake block becomes distant from the ground to be out of a range for safely braking the skate. Due to the fixed position of such brake blocks, they are not adjustable in height and new ones must be used to replace them to ensure the safety in skating. The frequent change of the brake blocks is apparently a non-economical waste which reduces the usable life of the brake blocks.

SUMMARY OF THE INVENTION

It is therefore a primary object of the present invention to provide a new brake mechanism for skates in which a brake block thereof is height-adjustably installed relative to the skates to meet the user's need and so as to increase the safety of skates in use. In addition, when the brake block of the brake mechanism is worn due to long term period of use and becomes shortened in length, the brake block can be shifted to adjust its height relative to the skate on which it is installed, such that the worn brake block can be fully utilized to provide a prolonged usable life.

DETAILED DESCRIPTION OF THE PREFERRED EMBODIMENT

Figure 1:
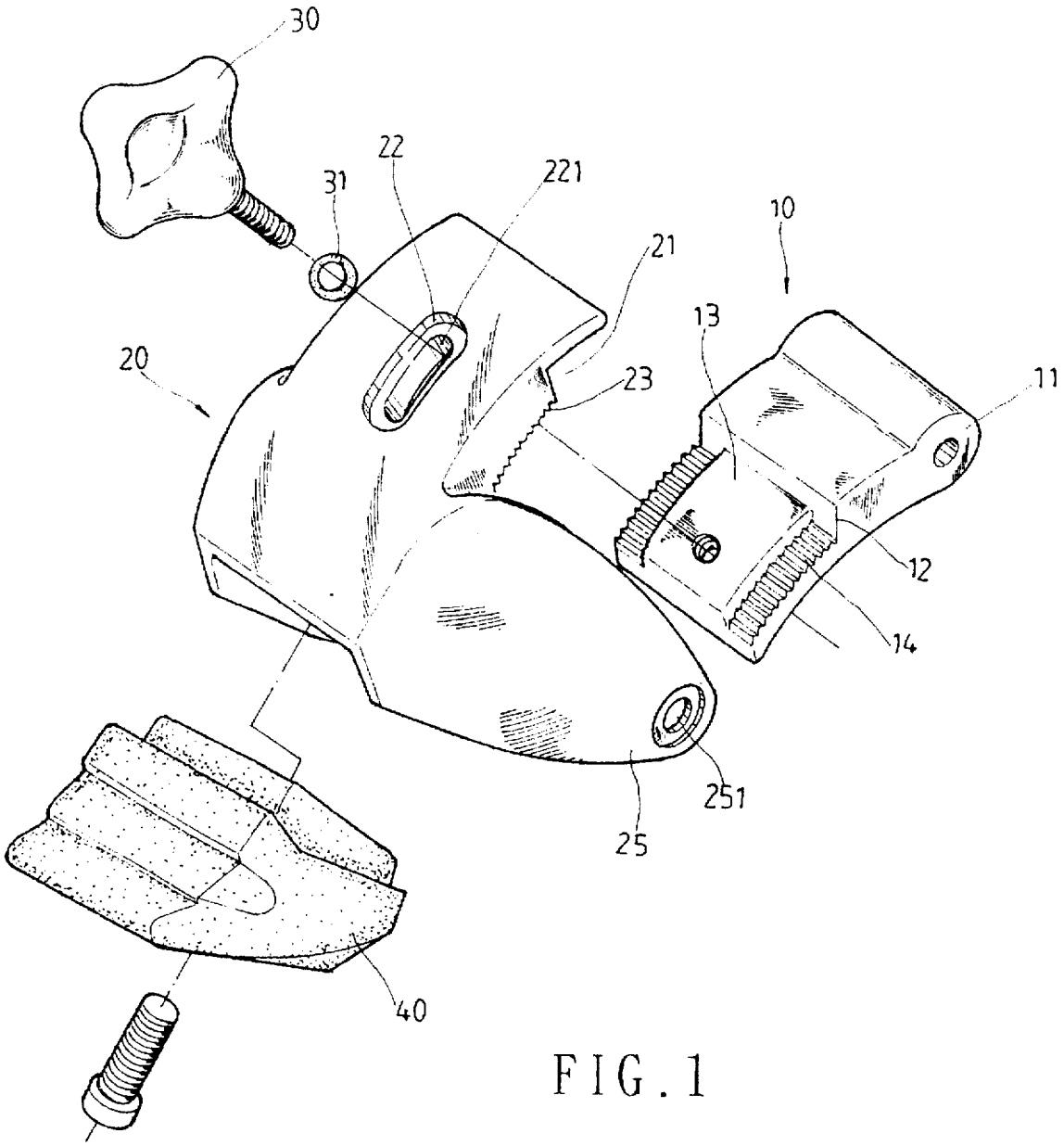
FIG. 1 is an exploded perspective of a brake mechanism for skates according to the present invention.
Figure 2:
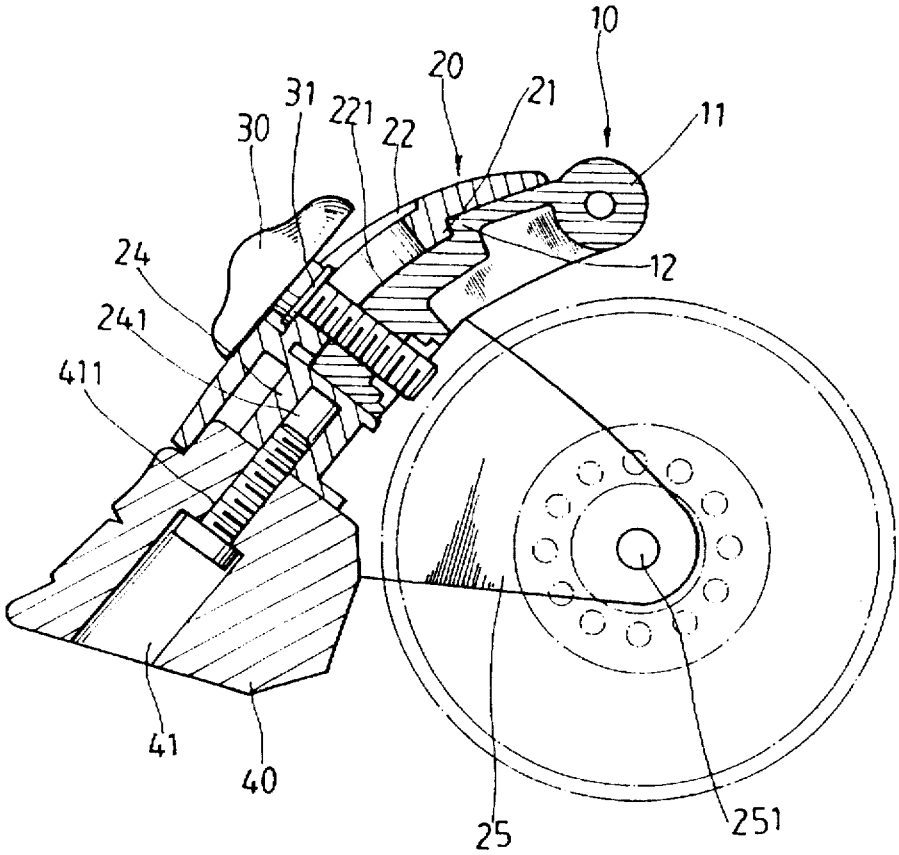
FIG. 2 is an assembled, side sectional view of the brake mechanism for skates according to the present invention.

Please refer to FIGS. 1 and 2. The present invention is a brake mechanism for roller skates and mainly includes a fixing member 10, a movable member 20, a fixing bolt member 30, and a brake block 40.

The fixing member 10 has a longitudinally extended curved body with two lateral side faces thereof perpendicular to top surface thereof. A front end of the fixing member 10 is formed of a transversely extended cylindrical portion 11 having a central through hole extending a full length of the cylindrical portion 11 for a fastening means, such as a bolt, to pass therethrough and thereby fixes the fixing member 10 to the skate at a proper position near a rear end thereof. A top portion of the cylindrical portion 11 forms an arched portion raised from the top surface of the fixing member 10. The fixing member 10 has a rear half which has a height lower than that of a front half thereof, forming a step 12 between the two halves. The rear half of the fixing member 10 further has a middle raised part extending from a rear end end of the fixing member 10 to the step 12. The raised part has a threaded through hole 13 provided thereon at a proper position. Portions 14 on the rear half of the fixing member 10 at two sides of the raised part have toothed top surface.

The movable member 20 has a substantially n-shaped cross section and an overall curve generally corresponding to that of the fixing member 10. A front portion of the movable member 20 has a thickness less than that at the other part of the movable member 20 and therefore, has the form of a plate part. This thickness difference forms a step 21 between the thinner plate part and the remaining rear part of the movable member 20. An oblong recess 22 is formed on a top surface of the movable member 20 at a predetermined position to extend in parallel to two lateral sides of the movable member 20. Inside the oblong recess 22, an oblong slot 221 smaller than the oblong recess 22 in width and length is further formed. Two lateral side faces of the movable member 20 perpendicular to the top surface thereof have toothed lower edges 23 which may engage with the toothed portions 14 of the fixing member 10. Near a rear bottom end of the movable member 20 there is a downward extended lower plate member 29 perpendicular to and having the same width as that of the top surface of the movable member 20. A fixing seat 24 projects from the lower plate member toward the rear bottom end of the movable member 20 in a direction substantially parallel to the top surface of the member 20 and perpendicular to the lower plate member. A threaded hole 241 is formed and centered on the fixing seat 24 to face backward. Two protective covers 25 separately downward extend from rear lateral sides of the movable member 20 to be perpendicular to the top surface of the member 20. A fixing hole 251 is provided on each of the protective covers 25 at a lower end thereof for a bolt to pass therethrough and thereby pivotally fixes the protective cover 25 to a hub of the last roller of the skate.

The fixing bolt member 30 is an externally threaded bolt having an enlarged-diameter head for conveniently turning the fixing bolt member 30.

The brake block 40 is the same as that usually used on the roller skates. The brake block has a lower hole 41 centered at a bottom side of the block 40 to extend into the block 40 for an adequate distance, and a through hole 411 having reduced diameter than the diameter of the lower hole 41 and extending from an inner end of the lower hole 41 to an upper side of the block 40 substantially opposite to the bottom side thereof. A threaded bolt is used to extend into the lower hole 41 and threads through the reduced hole 411 and into the threaded hole 241 of the fixing seat 24 at the rear bottom end of the movable member 20, so as to fixedly attach the brake block 40 to the movable member 20.

Figure 4:
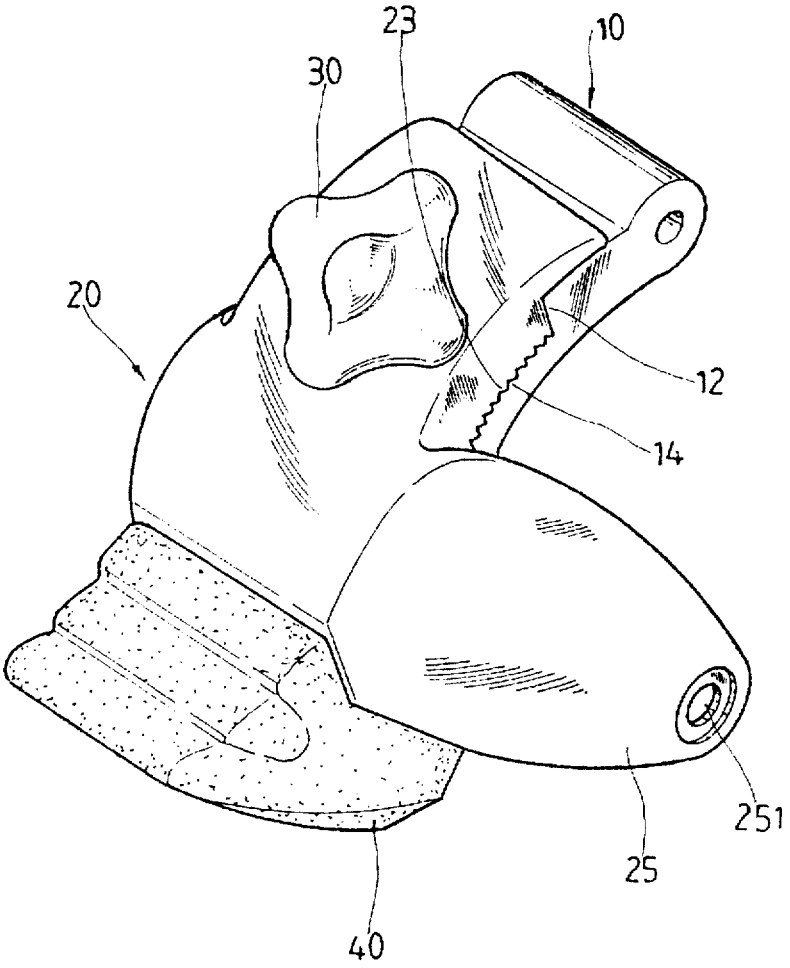
FIG. 4 is an assembled perspective of the present invention.
Figure 5:
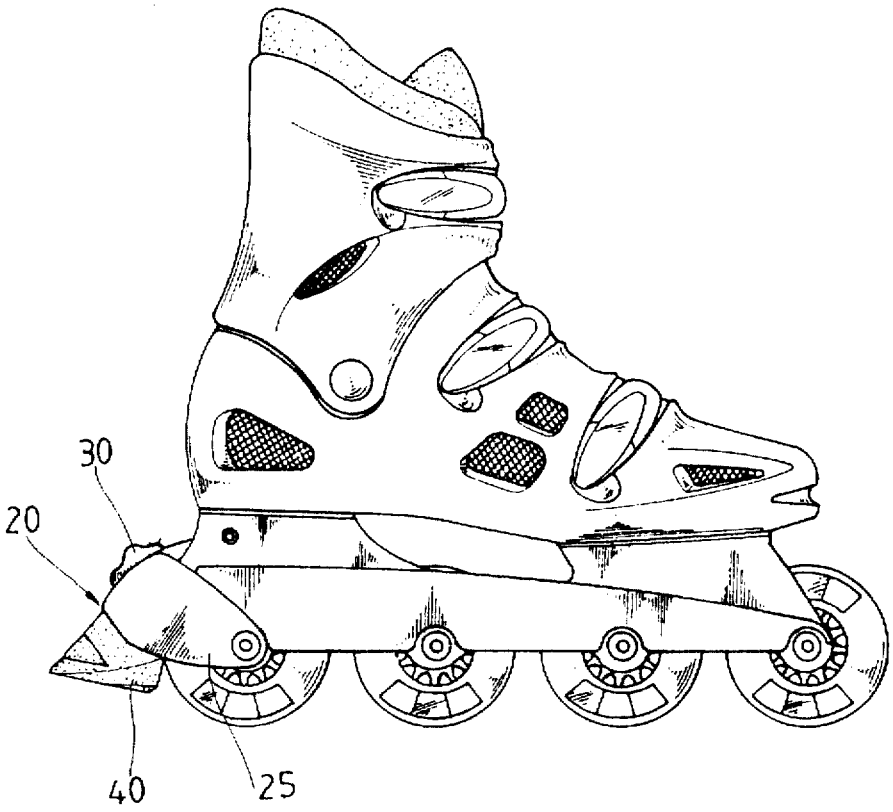
FIG. 5 illustrates an embodiment of the present invention being used with a roller skate.

Please refer to FIGS. 2, 4, and 5 for the assembly of the fixing member 10 with the movable member 20. The movable member 20 is fitly covered on the fixing member 10 by engaging the n-shaped rear part thereof with the raised part of the rear half of the fixing member 10 while the step 21 is fitly in contact with the step 12 in the vertical direction. At this point, the toothed lower edges 23 of the movable member 20 are located over the toothed top surfaces 14 of the fixing member 10 without being closely meshed with each other. Loosely screw the threaded bolt 30 through a washer 31 and into the oblong slot 221 on the top of the movable member 20 as well as the threaded through hole 13 on the top of the raised part of the fixing member 10, adjust the movable member 20 relative to the fixing member 10 by slightly push the former forward or backward until a desired position is obtained, and then, tightly fasten the bolt 30 into the threaded through hole 13 to firmly attach the movable member 20 to the fixing member 10.

Figure 3:
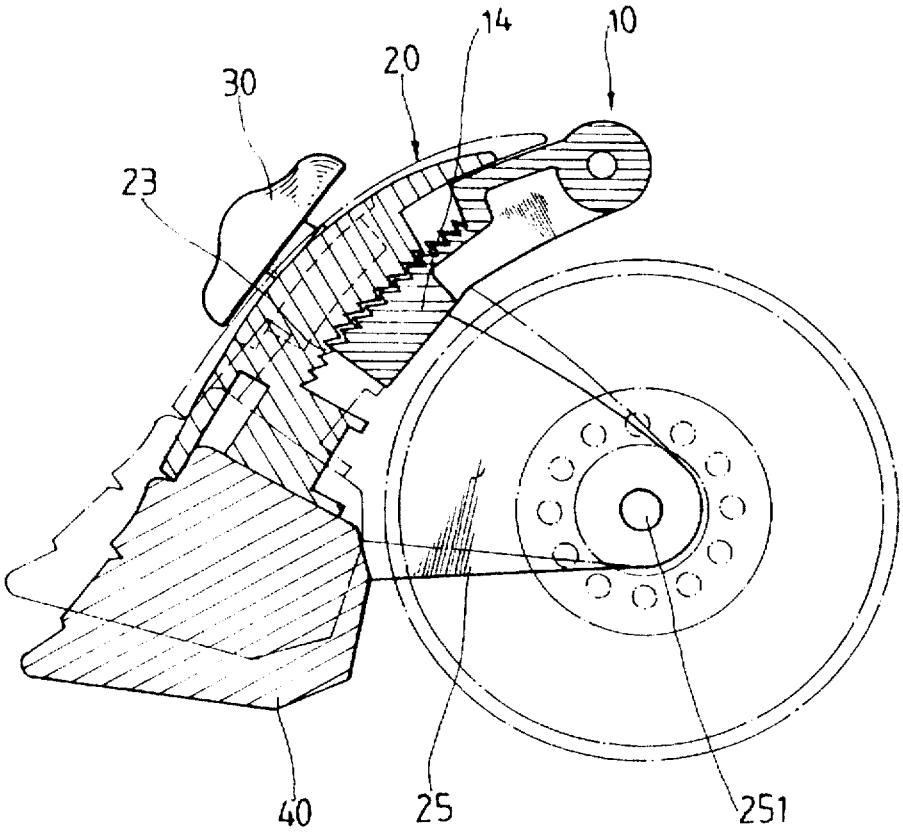
FIG. 3 illustrates the manner in which the brake mechanism of the present invention is adjusted to give the brake block thereof a different height relative to the skate.

When the brake block 40 installed at the rear bottom end of the movable member 20 is worn and becomes shortened, just loosen the bolt 30 from the threaded through hole 13 without moving the bolt 30 out of the oblong slot 221 and the oblong recess 22, allow the toothed lower edges 23 to disengage from the toothed top surfaces 14, adjust the movable member 20 by slightly pushing it backward until a desired position is obtained, and then, tighten the bolt 30 into the threaded through hole 13 again, as shown in FIG. 3.

What to be specially noted is that, due to the curved design of the bodies of the fixing member 10 and the movable member 20, teeth of the toothed lower edges 23 and of the top surfaces 14 have an inclination which permits the movable member 20 to be pushed backward (toward the ground) only during the adjustment of its position relative to the fixing member 10. With these declined teeth provided on two curved bodies, the movable member 20 can be ideally fixed to the fixing member 10 without the risk of unexpectedly moving forward to lengthen the distance between the brake block 40 and the ground that would adversely affect the safety of the roller skates in use.

With the above arrangements, the movable member 20 and the brake block 40 attached thereto at a lower position are both height adjustable relative to the fixing member 10 of the roller skates or to the ground and therefore meet the safe requirements of the user in using the skates to avoid undesired injury at ankles or other parts of the feet. In addition, the brake block 40 can be used for a longer period of time to provide higher economical benefit to the user.

What is claimed is:

1. A brake mechanism for roller skates, comprising a fixing member, a movable member, a fixing bolt member, and a brake block;

said fixing member having a longitudinally extended curved body with two lateral side faces thereof perpendicular to a top surface thereof, a front end of said fixing member being formed of a transversely extended cylindrical portion which has a central through hole extending a full length of said cylindrical portion for a fastening means to pass therethrough and thereby fixes said fixing member to a skate at a proper position near a rear end thereof, a top portion of said cylindrical portion forming an arched portion raised from said top surface of said fixing member, said fixing member further having a rear half which has a height lower than that of a front half thereof, forming a first step between said two halves, said rear half of said fixing member further having a middle raised part extending from a rear end of said fixing member to said first step, said raised part having a threaded through hole provided thereon at a proper position, and portions on said rear half of said fixing member at two sides of said raised part having toothed top surfaces;

said movable member having a substantially n-shaped cross section and an overall curvature substantially corresponding to that of said fixing member, a front portion of said movable member having a thickness less than that at a remaining rear part of said movable member and having the form of a plate part, such thickness difference forming a second step between the thinner plate part and said remaining rear part of said movable member, an oblong recess being formed on a top surface of said movable member at a predetermined position to extend in parallel to two lateral sides of said movable member, inside said oblong recess an oblong slot smaller than said oblong recess in width and length being further formed, two lateral side faces of said movable member perpendicular to said top surface thereof having toothed lower edges which may engage with said toothed top surfaces portions of said fixing member, near a rear bottom end of said movable member there being a downward extended lower plate member perpendicular to and having the same width as that of said top surface of said movable member, a fixing seat projecting from said lower plate member toward said rear bottom end of said movable member in a direction substantially parallel to said top surface of said movable member and perpendicular to said lower plate member, a threaded hole being formed and centered on said fixing seat to face rearwardly of said movable member, two protective covers separately downward extending from rear lateral sides of said movable member to be perpendicular to said top surface of said movable member, a fixing hole being provided on each of said protective covers at a lower end thereof for a bolt to pass therethrough and thereby pivotally fixing said protective cover to a hub of a last roller of said skate;

said fixing bolt member being an externally threaded bolt and having an enlarged-diameter head for conveniently turning said fixing bolt member; and said brake block having a lower hole centered at a bottom side of said brake block to extend into said brake block for an adequate distance, and a through hole having a reduced diameter than a diameter of said lower hole and extending from an inner end of said lower hole to an upper side of said brake block substantially opposite to said bottom side thereof, and said brake block being fixedly attached to said movable member by extending a threaded bolt into said lower hole and threading through said reduced hole and into said threaded hole of said fixing seat at said rear bottom end of said movable member;

wherein said movable member is fitly covered on said fixing member with said n-shaped rear part thereof in contact with an upward arched curved body of said fixing member and said toothed lower edges of said movable member located over said toothed top surfaces of said fixing member, and is firmly attached to said fixing member by threading said fixing bolt member through a washer and into said oblong slot on the top of said movable member as well as said threaded through hole on the top of said raised part of said fixing member; and wherein said fixing bolt member can be loosened to allow said movable member to be slightly moved rearwardly relative to said fixing member until a desired position is obtained, and then said fixing bolt member can be tightly fastened into said threaded through hole of said fixing member to firmly attach said movable member to said fixing member.

2. A brake mechanism for roller skates as claimed in claim 1, wherein said toothed top surfaces of said fixing member and said toothed lower edges of said movable member have teeth which are bedded on said curved bodies of said fixing and movable members and are so designed that they have a certain declination that permits said movable member to be moved rearwardly or toward the ground relative to said fixing member for adjustment purpose.

* * * * *